US005907272A

United States Patent [19]

McGuire

[11] Patent Number: 5,907,272

[45] Date of Patent: May 25, 1999

[54] SURFACE MOUNTABLE ELECTRICAL DEVICE COMPRISING A PTC ELEMENT AND A FUSIBLE LINK

[75] Inventor: Katherine M. McGuire, Clarendon Hills, Ill.

[73] Assignee: Littelfuse, Inc., Des Plaines, Ill.

[21] Appl. No.: 08/769,548

[22] Filed: Dec. 19, 1996

Related U.S. Application Data

[63] Continuation-in-part of application No. 08/642,597, May 3, 1996

[60] Provisional application No. 60/010,420, Jan. 22, 1996.

[51] Int. Cl.[6] ..... H01C 7/10

[52] U.S. Cl. ..... 338/22 R; 338/313; 337/183; 337/153; 337/184

[58] Field of Search ..... 338/22 R, 225 D, 338/313; 337/183, 153, 184

[56] References Cited

U.S. PATENT DOCUMENTS

| | | | |
|---|---|---|---|
| 3,708,720 | 1/1973 | Whitney et al. . | |
| 4,031,497 | 6/1977 | Ozawa | 338/308 |
| 4,096,464 | 6/1978 | Dennis et al. . | |
| 4,626,818 | 12/1986 | Hilgers | 337/166 |
| 4,654,510 | 3/1987 | Umeya et al. . | |
| 4,728,779 | 3/1988 | Kotani et al. . | |
| 4,780,598 | 10/1988 | Fahey et al. . | |
| 4,788,519 | 11/1988 | Swanson . | |
| 4,792,781 | 12/1988 | Takahashi et al. | 338/307 |
| 4,808,965 | 2/1989 | Cenky . | |
| 4,903,295 | 2/1990 | Shannon et al. . | |
| 4,912,450 | 3/1990 | Yoneda et al. | 338/22 R |
| 4,924,205 | 5/1990 | Caporali et al. | 338/227 |
| 4,959,505 | 9/1990 | Ott | 174/52.2 |
| 4,967,176 | 10/1990 | Horsma et al. . | |
| 4,992,771 | 2/1991 | Caporali et al. | 338/22 R |
| 5,208,723 | 5/1993 | Jenne . | |
| 5,210,516 | 5/1993 | Shikama et al. | 338/22 R |
| 5,229,739 | 7/1993 | Oh et al. . | |
| 5,239,163 | 8/1993 | Brouwers . | |
| 5,534,843 | 7/1996 | Tsunoda et al. | 338/22 R |
| 5,663,702 | 9/1997 | Shaw, Jr. et al. | 338/22 R |

FOREIGN PATENT DOCUMENTS

| | | |
|---|---|---|
| 0 575 783 A1 | 12/1993 | European Pat. Off. . |
| 41 43 095 C1 | 4/1993 | Germany . |
| 1066904 | 3/1989 | Japan . |
| 4078102 | 3/1992 | Japan . |
| 4078104 | 3/1992 | Japan . |
| 4114402 | 4/1992 | Japan . |
| 5299206 | 11/1993 | Japan . |
| 7-161503 | 6/1995 | Japan . |
| WO 94/01876 | 1/1994 | WIPO . |
| WO 95/08176 | 3/1995 | WIPO . |
| WO 95/31816 | 11/1995 | WIPO . |
| WO 95/33276 | 12/1995 | WIPO . |
| WO 95/34084 | 12/1995 | WIPO . |

OTHER PUBLICATIONS

Photographs of device manufactured by Rachem of California, sold as Catalog No. TR600–ISO.

*Primary Examiner*—Michael L. Gellner
*Assistant Examiner*—Karl Easthom
*Attorney, Agent, or Firm*—Wallenstein & Wagner, Ltd.

[57] ABSTRACT

Circuit protection device having a PTC element in series with a fusible element. The device includes a PTC element having first and second electrodes in electrical contact with the PTC element. An insulating layer is disposed on the first and second electrodes. Portions of the insulating layer are removed to form first and second contact points. A first conductive layer is in electrical contact with the first electrode and wraps around the PTC element. A portion of the first conductive layer forms a fusible element. A second conductive layer is in electrical contact with the second electrode. The wrap-around configuration of the device allows for an electrical connection to be made to both electrodes from the same side of the electrical device. The wrap-around configuration also permits current to flow in series through the PTC element and the fusible element for added protection from overcurrent conditions.

34 Claims, 6 Drawing Sheets

SURFACE MOUNTABLE ELECTRICAL DEVICE COMPRISING A PTC ELEMENT AND A FUSIBLE LINK

CROSS-REFERENCE TO RELATED APPLICATIONS

This application is a continuation-in-part of U.S. patent application Ser. No. 08/642,597 filed May 3, 1996, which claims the benefit of U.S. Provisional Application No. 60/010,420 filed Jan. 22, 1996.

TECHNICAL FIELD

The present invention relates generally to a surface mountable electrical circuit protection device and a method for making the device.

BACKGROUND OF THE INVENTION

It is well known that the resistivity of many conductive materials change with temperature. Resistivity of a positive temperature coefficient ("PTC") material increases as the temperature of the material increases. Many crystalline polymers, made electrically conductive by dispersing conductive fillers therein, exhibit this PTC effect. These polymers generally include polyolefins such as polyethylene, polypropylene and ethylene/propylene copolymers. Certain doped ceramics such as barium titanate also exhibit PTC behavior.

At temperatures below a certain value, i.e., the critical or switching temperature, the PTC material exhibits a relatively low, constant resistivity. However, as the temperature of the PTC material increases beyond this point, the resistivity sharply increases with only a slight increase in temperature.

Electrical devices employing polymer and ceramic materials exhibiting PTC behavior have been used as overcurrent protection in electrical circuits. Under normal operating conditions in the electrical circuit, the resistance of the load and the PTC device is such that relatively little current flows through the PTC device. Thus, the temperature of the device due to $I^2R$ heating remains below the critical or switching temperature of the PTC device. The device is said to be in an equilibrium state (i.e., the rate at which heat is generated by $I^2R$ heating is equal to the rate at which the device is able to lose heat to its surroundings).

If the load is short circuited or the circuit experiences a power surge, the current flowing through the PTC device increases and the temperature of the PTC device (due to $I^2R$ heating) rises rapidly to its critical temperature. At this point, a great deal of power is dissipated in the PTC device and the PTC device becomes unstable (i.e., the rate at which the device generates heat is greater than the rate at which the device can lose heat to its surroundings). This power dissipation only occurs for a short period of time (i.e., a fraction of a second), however, because the increased power dissipation will raise the temperature of the PTC device to a value where the resistance of the PTC device has become so high that the current in the circuit is limited to a relatively low value. This new current value is enough to maintain the PTC device at a new, high temperature/high resistance equilibrium point, but will not damage the electrical circuit components. Thus, the PTC device acts as a form of a fuse, reducing the current flow through the short circuit load to a safe, relatively low value when the PTC device is heated to its critical temperature range. Upon interrupting the current in the circuit, or removing the condition responsible for the short circuit (or power surge), the PTC device will cool down below its critical temperature to its normal operating, low resistance state. The effect is a resettable, electrical circuit protection device.

Particularly useful devices of this type generally include a PTC element sandwiched between a pair of laminar electrodes. In order to connect devices of this type to other electrical components, terminals are commonly soldered to the electrode. The soldering process, however, can adversely affect the resistance of a polymeric PTC element. Moreover, since electrical connection generally occurs on opposing sides of the PTC element, devices of this type commonly take up more space on a PC board than is necessary.

SUMMARY OF THE INVENTION

We have now discovered that electrical connection can be made to both electrodes from the same side of a PTC device by employing the wrap-around configuration of the present invention. This configuration makes an electrical connection by wrapping a conductive layer around the PTC element rather than putting a conductive layer through an aperture in the PTC element. Accordingly, the devices of the present invention utilize the entire PTC element.

Further, the manufacturing steps necessary to produce electrical devices according to the present invention allow for numerous strips to be prepared simultaneously, with the final strips ultimately divided into a plurality of electrical devices. This process makes it possible to reduce the size and, hence, the resistance of the electrical devices of the present invention.

Moreover, we have discovered that the wrap-around configuration of devices according to the present invention allows for a fusible element to be connected in series with the PTC element. This provides additional overcurrent protection for extreme fault conditions.

In one aspect, the present invention provides an electrical device comprising first and second electrodes in electrical contact with a PTC element. The PTC element includes first and second sidewalls connected to top and bottom surfaces. An insulating layer is deposited on the first and second electrodes and has portions removed to form first and second contact points. First and second conductive layers electrically contact the first and second electrodes respectively. A portion of the first conductive layer forms a fusible element such that the PTC element and the fusible element are electrically connected in series.

In a second aspect, the present invention provides an electrical device comprising a PTC element having first and second sidewalls connected to top and bottom surfaces. The PTC element is composed of a crystalline polymer having a conductive filler dispersed therein. First and second electrodes are in electrical contact with the PTC element. A first insulating layer is disposed on the first and second electrodes. First and second conductive layers are in electrical contact with the first and second electrodes at first and second contact points, respectively. A portion of the first conductive layer forms a fusible element such that the fusible element is electrically connected in series with the PTC element. A second insulating layer covers the fusible element. A third conductive layer is disposed on the second conductive layer and a fourth conductive layer is disposed on the third conductive layer.

A third and final aspect of the present invention provides a PTC element having first and second sidewalls connected to top and bottom surfaces. The PTC element is composed of a crystalline polymer having carbon particles dispersed therein and has an electrical resistivity at approximately 25° C. of less than 10 ohm cm. First and second electrodes are in electrical contact with the PTC element. A first insulating layer is disposed on the first and second electrodes. First and second conductive layers comprised of copper are in electrical contact with the first and second electrodes at the first and second contact points, respectively. The conductive layers wrap around the first and second sidewalls of the PTC element, respectively. A portion of the first conductive layer forms a fusible element such that the fusible element is electrically connected in series with the PTC element. The fusible element is covered by a second insulating layer. A third conductive layer comprising nickel is disposed on the second conductive layer. A fourth conductive layer comprising solder is disposed on the third conductive layer.

BRIEF DESCRIPTION OF THE DRAWINGS

A better understanding of the present invention will be had upon reference to the following detailed description and accompanying drawings. The size and thickness of the various elements illustrated in the drawings has been greatly exaggerated to more clearly show the electrical devices of the present invention.

DETAILED DESCRIPTION OF THE INVENTION

Figure 4:
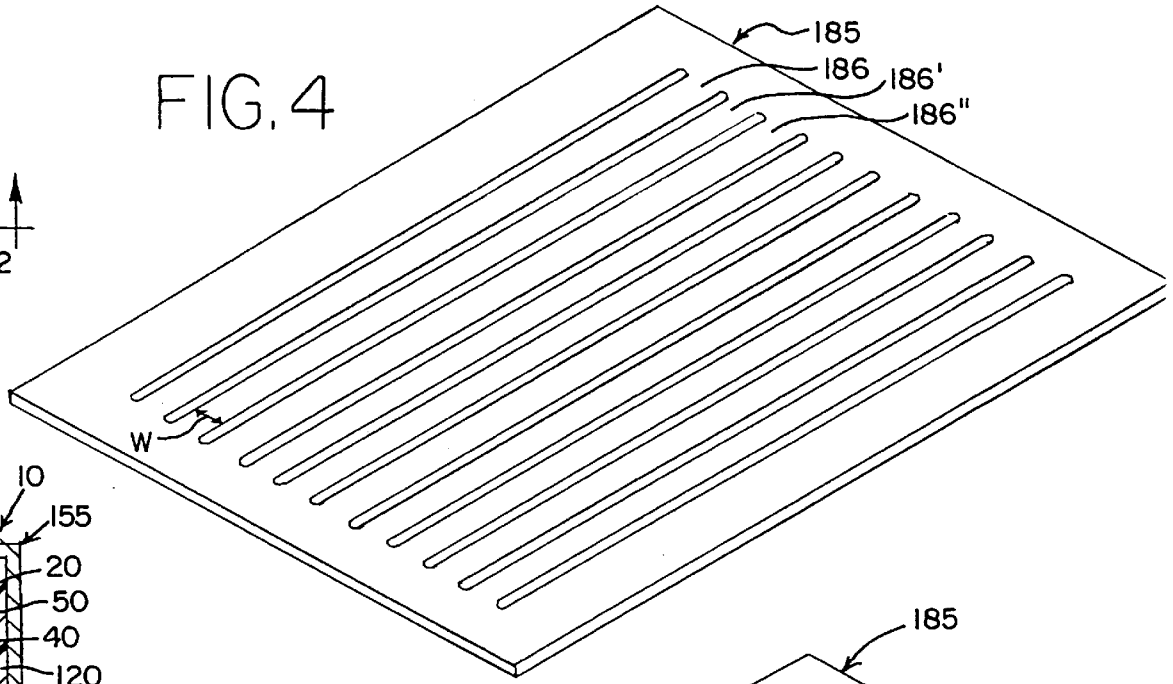
FIG. 4 is a perspective view of a laminar PTC sheet having a plurality of strips created in a regular pattern.

While this invention is susceptible of embodiment in many different forms, there is shown in the drawings and will herein be described in detail preferred embodiments of the invention with the understanding that the present disclosure is to be considered as an exemplification of the principles of the invention. For example, the present invention will be described below generally with reference to a polymer PTC element having electrodes formed on the top and bottom surfaces. It is to be understood, however, that the present invention contemplates electrical devices with a ceramic PTC element, or a resistive element that does not exhibit PTC characteristics. Generally, the resistive element of the present invention will be composed of a PTC composition comprised of a polymer component and a conductive filler component. The polymer component may be a single polymer or a mixture of two or more different polymers. The polymer component may comprise a polyolefin having a crystallinity of at least 40%. Suitable polymers include polyethylene, polypropylene, polybutadiene, polyethylene acrylates, ethylene acrylic acid copolymers, and ethylene propylene copolymers. In a preferred embodiment, the polymer component comprises polyethylene and maleic anhydride (such a polymer is manufactured by DuPont and sold under the trade name Fusabond™). The conductive filler component is dispersed throughout the polymer component in an amount sufficient to ensure that the composition exhibits PTC behavior. Alternatively, the conductive filler can be grafted to the polymer. Generally, the conductive filler component will be present in the PTC composition by approximately 25–75% by weight. Suitable conductive fillers to be used in the present invention include powders, flakes or spheres of the following metals; nickel, silver, gold, copper, silver-plated copper, or metal alloys. The conductive filler may also comprise carbon black, carbon flakes or spheres, or graphite. In a preferred embodiment, the conductive filler component used in the present invention is carbon black (manufactured by Columbian Chemicals and sold under the tradename Raven™). Particularly useful PTC compositions have a resistivity at approximately 25° C. of less than 10 ohm cm, particularly less than 5 ohm cm, and especially less than 3 ohm cm. Suitable PTC compositions for use in the present invention are disclosed in U.S. patent application No. 08/614,038, and U.S. Pat. Nos. 4,237,441; 4,304,987; 4,849,133; 4,880,577; 4,910,389 and 5,190,697.

The PTC element has a first electrode in electrical contact with the top surface and a second electrode in electrical contact with the bottom surface. The electrodes may be in direct physical contact with the top and bottom surfaces of the PTC element, however, electrical devices of the present invention may also include a conductive adhesive composition which lies between the electrodes and the PTC element.

In a preferred embodiment, the PTC element is sandwiched between two metal foil electrodes to form a laminate. Alternatively, the electrodes can be formed on the top and bottom surfaces of the PTC element using conventional electroless or electrolytic plating processes. The first and second electrodes preferably comprise a metal selected from the group consisting of nickel, copper, silver, tin, gold and alloys thereof.

Figure 1:
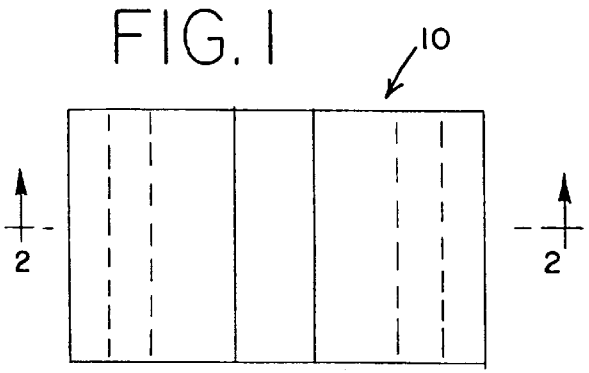
FIG. 1 is a top view of an electrical device according to the present invention.
Figure 2:
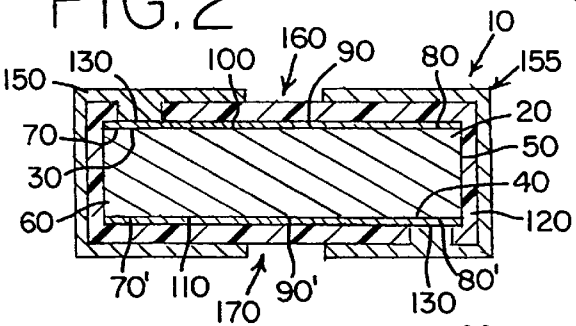
FIG. 2 is a cross-sectional view along line a—a of a first embodiment of the electrical device illustrated in FIG. 1.
Figure 3:
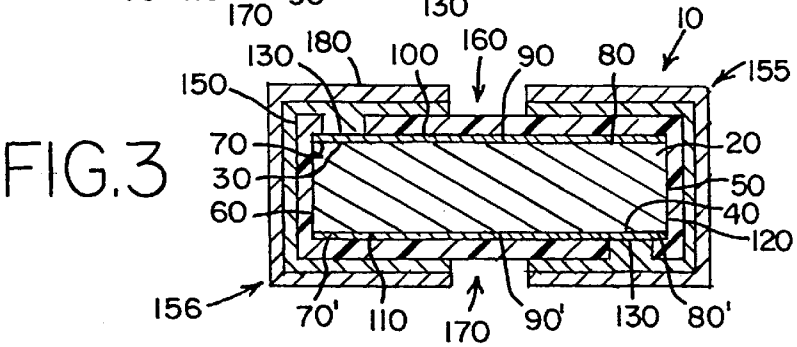
FIG. 3 is a cross-sectional view along line a—a of a second embodiment of the electrical device illustrated in FIG. 1.

With reference now to FIGS. 1–3, the electrical device 10 of the present invention comprises a resistive element 20 having a top surface 30, a bottom surface 40, a first side 50 and a second side 60. Both the top and bottom surfaces 30, 40 have two end portions 70, 80 and 70', 80' separated by mid-portions 90, 90'. A first electrode 100 is formed on the top surface 30 of resistive element 20 and a second electrode 110 is formed on the bottom surface 40 of resistive element 20. As previously mentioned, preferably resistive element 20 is composed of a polymer PTC composition.

An insulating layer 120 is formed on electrodes 100, 110 and the first side 50 and the second side 60 of the resistive element 20. The insulating layer 120 can be composed of a photo resist material, a dielectric material, a ceramic material, a solder mask, or any electrically non-conductive material. The insulating layer 120 has a portion removed from the first electrode 100 to define a first contact point 130 and a portion removed from the second electrode 110 to define a second contact point 140. In the preferred embodiments illustrated in FIGS. 2–3, the first contact point 130 is adjacent the end portion 70 of the top surface 30 of the resistive element 20, while the second contact point 140 is adjacent the end portion 80 of the bottom surface 40 of the resistive element 20 (i.e., the first and second contact points 130, 140 are located on opposite sides and opposite ends of the electrical device 10). While this configuration is preferred, the present invention covers electrical devices having contact points located anywhere along the first and second electrodes provided that electrical connection can be made to both electrodes from the same side of the electrical device.

A first conductive layer 150 is formed on the insulating layer 120 and makes electrical contact with the first and second electrodes 100, 110 at first and second contact points 130, 140. Conductive layer 150 may be comprised of any conductive material, but preferably comprises a metal selected from the group consisting of copper, tin, silver, nickel, gold and alloys thereof. It is important that the first conductive layer wrap-around the sides of the electrical device. This wrap-around configuration allows for electrical connection to be made to both electrodes from the same side of the electrical device.

The first conductive layer 150 has portions removed from insulating layer 120 to form end terminations 155, 156. Each end termination includes a contact point. The end terminations 155, 156 are separated by electrically non-conductive gaps 160, 170. FIGS. 2–3 illustrate an electrical device 10 wherein the electrically non-conductive gaps 160, 170 are formed adjacent the mid-portions 90, 90' of the top and bottom surfaces 30, 40 of resistive element 20. It should be understood, however, that the electrically non-conductive gaps 160, 170 can be formed anywhere in the first conductive layer 150 as long as the electrically non-conductive gaps separate end terminations 155, 156, with each end termination including a contact point. This configuration prevents current from flowing circularly around the electrical device. Instead, current may flow around either end portion of the electrical device via an end termination, to the first contact point, and through the resistive element to the second contact point formed on the opposite side of the electrical device.

The electrically non-conductive gaps 160, 170 can be formed by a conventional etching process. In FIGS. 2–3, the non-conductive gaps 160, 170 are left vacant, thus exposing insulating layer 120. Alternatively, the non-conductive gaps 160, 170 can be filled with any electrically non-conductive material.

Referring specifically to FIG. 3, in a preferred embodiment of the present invention, a second conductive layer 180 is formed on the first conductive layer 150. The second conductive layer should not bridge non-conductive gaps 160, 170 or any electrically non-conductive material which might fill the non-conductive gaps 160, 170. The second conductive layer 180 is preferably a solder composition which allows the device 10 to be easily connected to the conductive terminals of a PC board. By completely coating the first conductive layer 150 with the second conductive layer 180, the electrical device 10 of the preferred embodiment is symmetrical. Accordingly, the device 10 does not need to be oriented in a special manner before it is mounted to a PC board or connected to additional electrical components. It should be understood, however, that the present invention covers an electrical device 10 where the second conductive layer 180 contacts only a portion of the first conductive layer 150, or is in contact with the first conductive layer 150 on one side of the device only, i.e., a non-symmetrical device.

Electrical devices of the present invention have a resistance at approximately 25° C. of less than 1 ohm, preferably less than 0.5 ohm, and especially less than 0.2 ohm.

The electrical devices of the present invention can be manufactured in various ways. However, as illustrated in FIG. 4, the preferred method provides for carrying out the processing steps on a relatively large laminar sheet 185 which comprises a plurality of strips 186, 186', 186", etc. The final processing step includes dividing the strips into a plurality of electrical devices. Accordingly, extremely small electrical devices with low resistances can be produced in an economical fashion.

In a preferred method, electrodes are formed on the top and bottom surfaces of a solid laminar PTC sheet of convenient size. As previously mentioned, preferably the PTC sheet is laminated between two metal foil electrodes. Alternatively, electrodes may be plated directly on the top and bottom surfaces of the PTC sheet using conventional electrolytic or electroless plating processes. Referring to FIG. 4, the terminated laminar PTC sheet is then routed or punched to create a plurality of strips 186, 186', 186", etc. The strips are created in a regular pattern and preferably have a width, W, approximately the desired length of the final electrical device. For example, a laminar PTC sheet approximately 6 inches wide by 8 inches long by 0.0150 inches thick may be routed or punched to create a plurality of strips 186, 186', 186", etc. approximately 7 inches in length with a width of approximately 0.160–0.180 inches or less. The top and bottom surfaces of each strip are composed of the first and second electrodes 100, 110. The side surfaces of each strip are composed of PTC element 20 due to the routing or punching procedure.

Figure 4A:
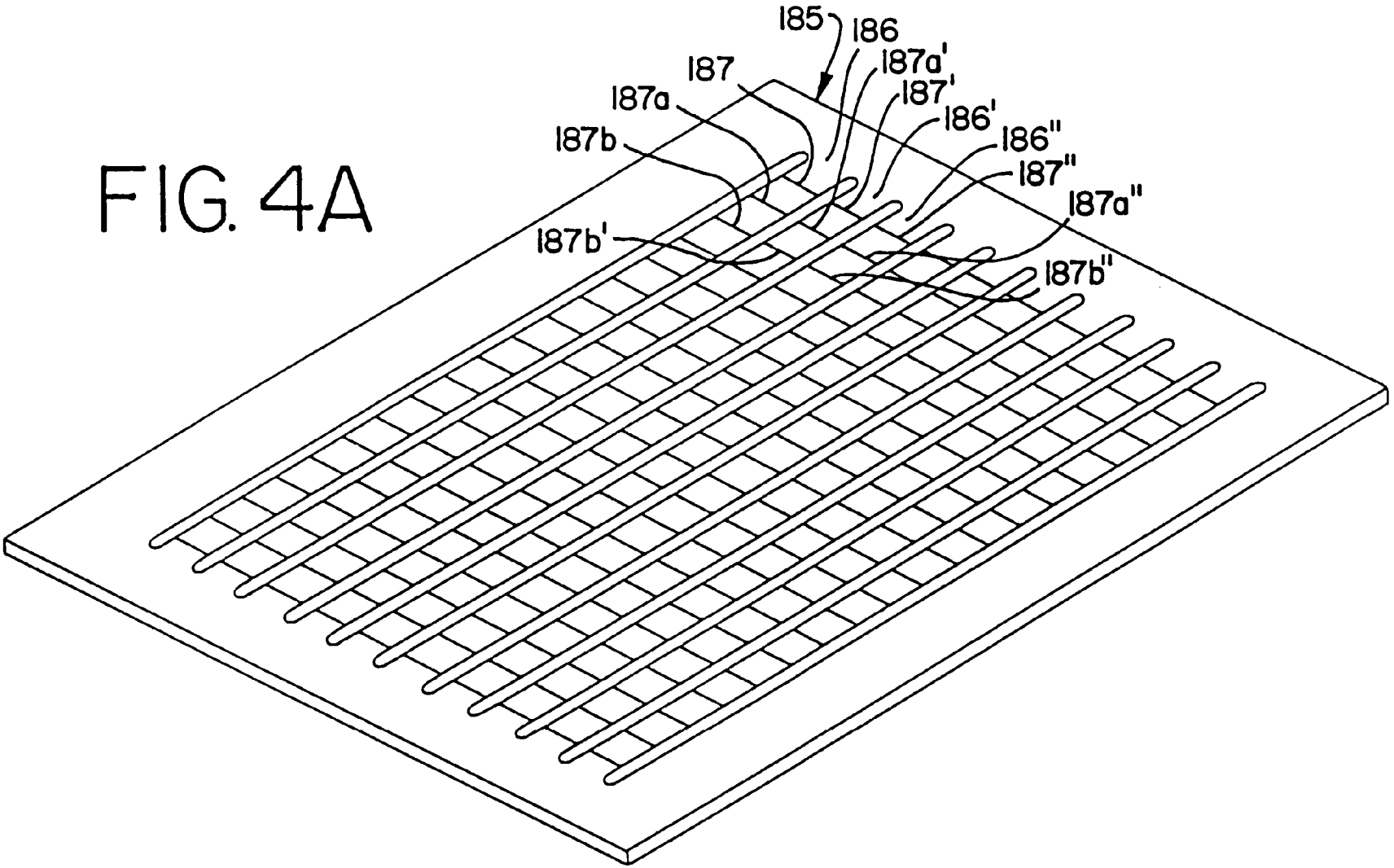
FIG. 4A is a perspective view of the laminar PTC sheet illustrated in FIG. 4 having a plurality of break points created on each strip.

After the laminated PTC sheet is routed, a plurality of break points 187, 187', 187" . . . 187*a*, 187*a'*, 187*a"* . . . 187*b*, 187*b'*, 187*b"* . . . etc. are created horizontally across each strip (FIG. 4A). The break points allow the final strips to be divided into a plurality of electrical devices by exerting minimal pressure at each break point. Thus, the final strips can be efficiently divided into a plurality of electrical devices by snapping or simply running the strip over an edge. Laboratory tests have indicated that without break points, the conductive layers (described in detail below) tend to smear upon dividing the strips into electrical devices with conventional dicing and shearing techniques. Smeared conductive layers lead to faulty electrical devices and the increased possibility of short circuits.

Generally, the break points are created by removing portions of the electrodes on both the top and bottom surfaces of each strip. This can be accomplished by laminating the routed, terminated PTC sheet illustrated in FIG. 4 with a dry film photo resist material. A masking material is laid over the portions of the photo resist material which are to be developed or cured, leaving a plurality of unmasked regions approximately 5 mils thick stretching horizontally across each strip. Preferably, the unmasked regions are formed on the routed, terminated laminar PTC sheet in the same direction as the direction in which the PTC composition was extruded. Since the polymer chains in the PTC composition are elongated in the direction of extrusion, the brittleness of the PTC sheet is anisotropic. That is, the PTC sheet is stronger in one direction (i.e., perpendicular to the direction of extrusion) than it is in the direction parallel to extrusion. Thus, by creating the break points parallel to the direction of extrusion, the final strips may be easily divided into a plurality of electrical devices.

The unmasked regions should be created to leave a plurality of masked portions having a dimension approximately equal to the desired width of the final electrical device, e.g., 0.100–0.150 inches or less. The strips are then exposed to ultraviolet light whereby the unmasked regions of the photo resist material degrade. The degraded photo resist material is rinsed away to expose portions of the electrode surfaces. The exposed portions of the electrodes are then removed by a conventional etching process (e.g., subjecting the exposed electrode surfaces to a ferric chloride solution), thus, creating a plurality break points. Finally, the developed or cured dry film photo resist material is chemically removed by dipping the PTC sheet into a solvent such as potassium hydroxide.

Figure 5:
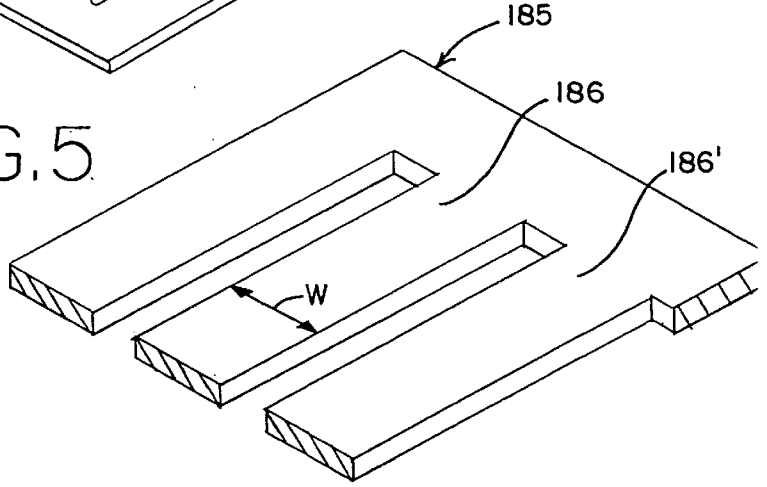
FIG. 5 is a partial enlarged perspective view of the laminar PTC sheet having a plurality of strips as illustrated in FIG. 4.

FIG. 5 illustrates a partial enlarged cross-sectional view of several strips of the laminar PTC sheet. While the various process steps are to be carried out after the break points have been formed on the routed PTC sheet, for purposes of clarity, the various process steps will be discussed with reference to a cross-section of a single strip (illustrated in FIGS. 6A–6H and 7A–7D).

Figure 6A:
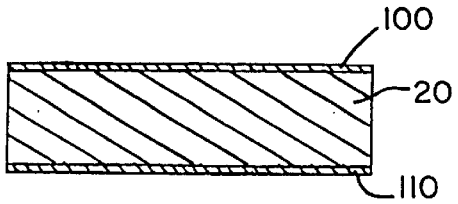
FIGS. 6A–6H illustrate the various steps of a preferred method of manufacturing electrical devices of the present invention, as applied to a cross-section of a single strip of the PTC sheet in FIG. 4A.
Figure 6B:
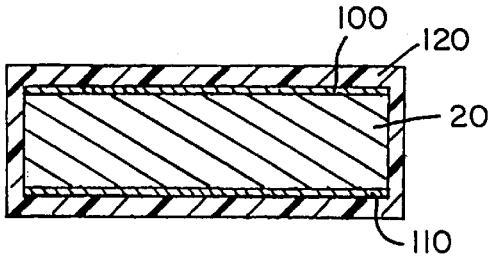

After the break points have been created on each strip of the routed, terminated laminar PTC sheet (FIG. 6A), the strips of the laminar PTC sheet are coated with an insulating layer 120 (FIG. 6B). The insulating layer 120 may be applied using any one of the following conventional techniques: brushing, laminating, dipping, screen printing or spraying. The insulating layer 120 may comprise any electrically non-conductive material, however, preferred materials include a photo resist material, a ceramic material, a dielectric material, or a solder mask.

Figure 6C:
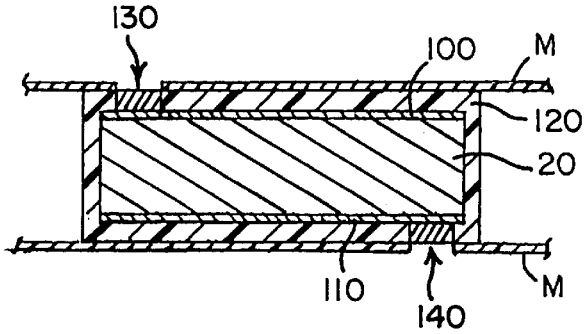
Figure 6D:
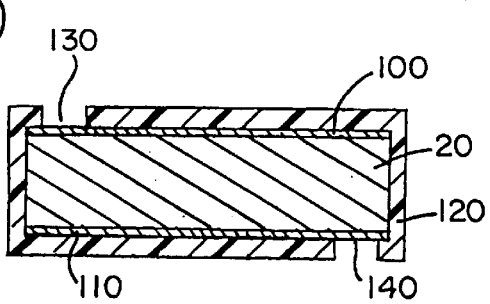

A plurality of contact points 130, 140, are formed in a regular pattern on the top and bottom surfaces of each strip (FIGS. 6C–6D). It should be understood that the present invention covers methods where the insulating layer 120 is applied to the strips leaving portions of the electrodes 100, 110 initially exposed to create the contact points 130, 140. Additionally, the present invention covers methods where the insulating layer 120 is initially applied to the entire surface of each strip. Contact points 130, 140 are then formed by removing portions of the insulating layer 120. For example, referring to FIGS. 6B–6D, a positive working photo resist material is used as the insulating layer 120. A mask, reference letter M in FIG. 6C, is applied to the portions of the photo resist material which are to be developed or cured on the surfaces of each strip, leaving portions of the photo resist material which will form the contact points 130, 140 unmasked (shown as cross-hatched portions of the insulating layer in FIG. 6C). The strips are then exposed to ultraviolet light whereby the unmasked portions of the photo resist material degrade. The degraded photo resist material is rinsed away to expose the electrode surfaces (FIG. 6D), thus, forming a plurality of contact points on the top and bottom surfaces of each strip. This process can be reversed using a negative photo resist material (i.e., the unmasked portions will develop or cure upon exposure to ultraviolet light).

Figure 6E:
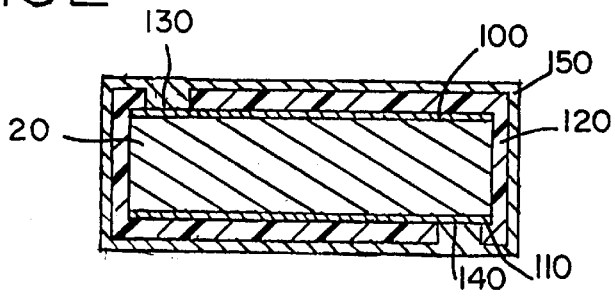

After the plurality of contact points 130, 140 has been formed, a first conductive layer 150 is applied to the strips (FIG. 6E). The conductive layer 150 may be applied by a conventional plating technique (e.g., electroless plating). Alternatively, the conductive layer may be applied by dipping, spraying or brushing a conductive material to the strips in a liquid form. In a preferred embodiment the first conductive layer 150 comprises a metal selected from the group consisting of nickel, copper, tin, silver, gold or alloys thereof. The first conductive layer 150 must make electrical contact with the electrodes 100, 110 at each contact point formed on the strips.

As illustrated in FIGS. 2–3 and 6E, the first conductive layer 150 wraps around the end portions of the electrical device 10. This wrap-around configuration makes it possible to make electrical contact to both electrodes from the same side of the electrical device.

Figure 6F:
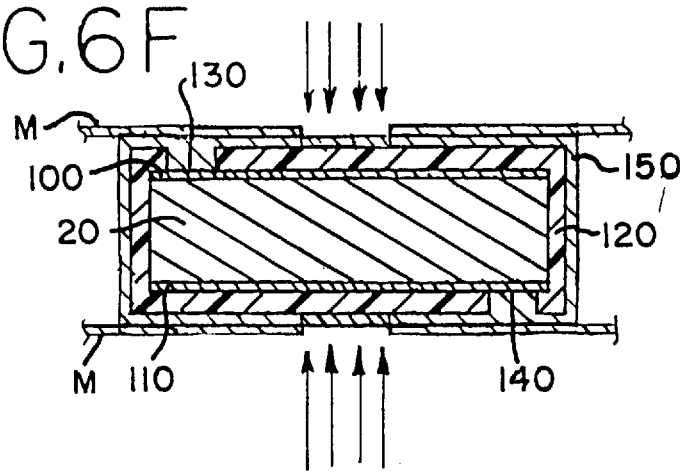
Figure 6G:
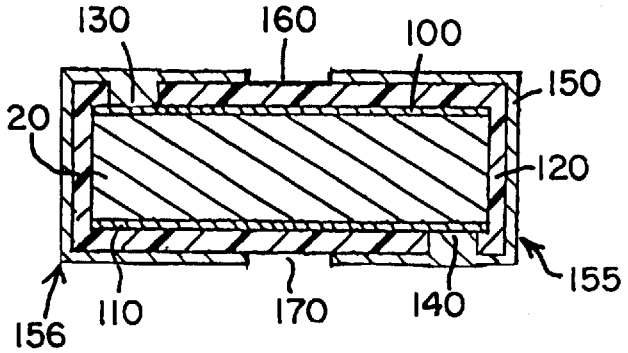

In the next step, a plurality of electrically non-conductive gaps 160, 170 are formed in the first conductive layer 150 in a regular pattern on the top and bottom surfaces of each strip (FIGS. 6F–6G). The electrically non-conductive gaps 160, 170 may be formed by applying the first conductive layer 150 initially in a manner which leaves portions of the insulating layer 120 exposed. However, the present invention also covers methods where each strip is completely covered with the first conductive layer 150 and the electrically non-conductive gaps 160, 170 are created by removing portions of the first conductive layer 150 in a regular pattern on the top and bottom surfaces of each strip. Either process results in forming on each strip a plurality of first and second end terminations 155, 156 separated by the electrically non-conductive gaps 160, 170.

For example, with reference to FIGS. 6E–6G, a protective mask, reference letter M in FIG. 6F, is applied to the conductive layer 150, leaving predetermined portions exposed (the exposed portions are represented by the cross-hatched sections of the conductive layer 150 in FIG. 6F). The exposed portions are then removed by a conventional etching process, e.g., subjecting the exposed portions to a ferric chloride solution.

Figure 7A:
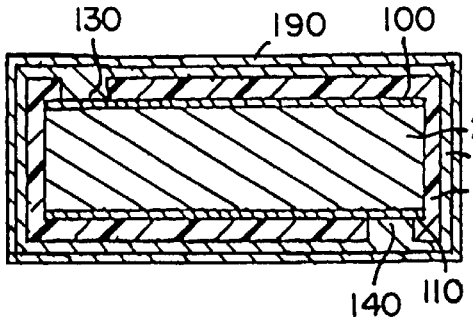
FIGS. 7A–7D illustrate the steps of a second preferred method of manufacturing electrical devices of the present invention, starting with the device illustrated in FIG. 6E.
Figure 7B:
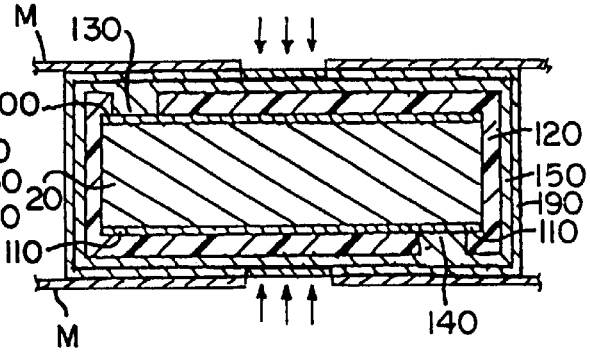
Figure 7C:
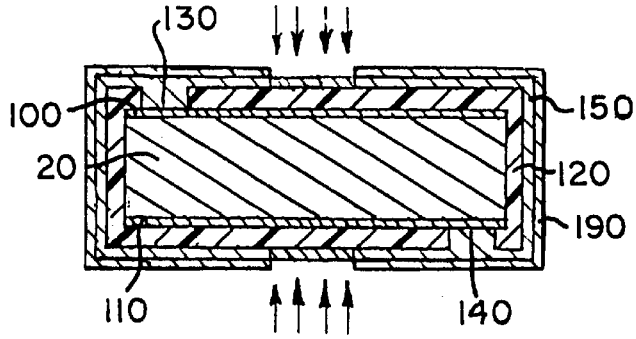

Alternatively, the electrically non-conductive gaps 160, 170 and end terminations 155, 156 can be formed by the following method. First conductive layer 150 is applied to each strip, coating insulating layer 120 and contact points 130, 140 (FIG. 6E). Referring now to FIGS. 7A–7D, a photo resist material 190 is applied to the conductive layer 150. If a photo resist material is used to form insulating layer 120, then the second photo resist material 190 used in this step must have an opposite reaction to ultraviolet light (i.e., if a negative-working photo resist material was used to form the insulating layer, than a positive-working photo resist material must be used to form the electrically non-conductive gaps in the conductive layer and vice-versa). A masking material, reference letter M in FIG. 7B, is applied to the outer photo resist layer 190, leaving a plurality of portions of the top and bottom surfaces of the layer 190 exposed in a regular pattern. The strips are then subjected to ultraviolet light, causing the unmasked portions of the outer photo resist layer 190 to degrade. The degraded portions of the photo-resist material 190 are rinsed away, leaving a plurality of portions of the first conductive layer 150 exposed in a regular pattern on the top and bottom surfaces of each strip (FIG. 7C). The exposed portions of the conductive layer 150 (shown as cross-hatched sections of the conductive layer in FIG. 7C) are then removed by dipping the strips in a standard etching solution.

Figure 7D:
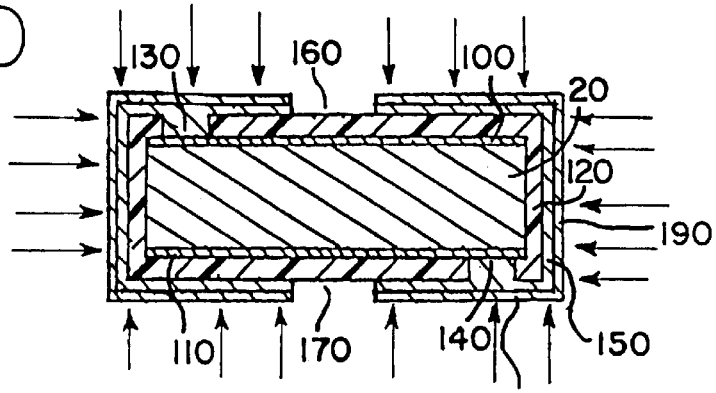

As a result, portions of insulating layer 120 are exposed. The outer photo resist material 190 is then removed by further exposing the strips to ultraviolet light (FIG. 7D). Since portions of the insulating layer 120 are exposed during this step, it is important to use a photo resist material 190 which has an opposite reaction to ultraviolet light than the photo resist material that may have been used to form insulating layer 120.

As a result of either process, i.e., (1) applying the conductive layer to the entire surface of the strips and then removing portions of the conductive layer or, (2) initially applying the conductive layer in a manner which leaves portions of the insulating layer exposed, first and second end terminations 155, 156 are formed (FIG. 6G).

Figure 6H:
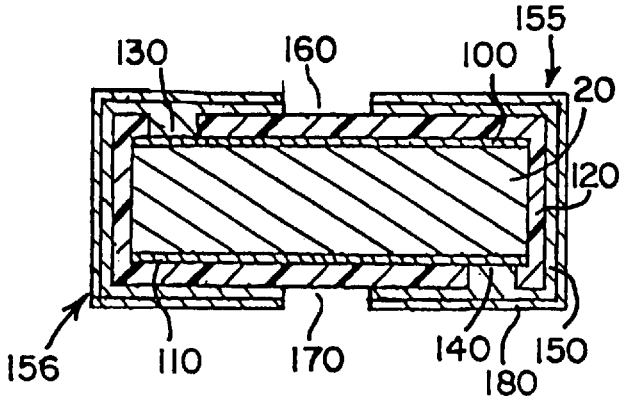

In the preferred embodiment illustrated in FIGS. 3 and 6H, a second conductive layer 180 is applied to the first conductive layer 150. The second conductive layer 180 is preferably comprised of a solder composition and can be applied by any conventional process, including electrolytic plating or solder dipping. The layer of solder permits the electrical devices 10 of the present invention to be easily connected to the conductive terminals of a PC board.

In the final step, the strips are divided at each break point into a plurality of electrical devices such that each device has a contact point and an electrically non-conductive gap on both sides (i.e., top and bottom) of the device. As previously mentioned, the strips may be divided into a plurality of electrical devices by simply applying a minimal amount of pressure at each break point.

Figure 8:
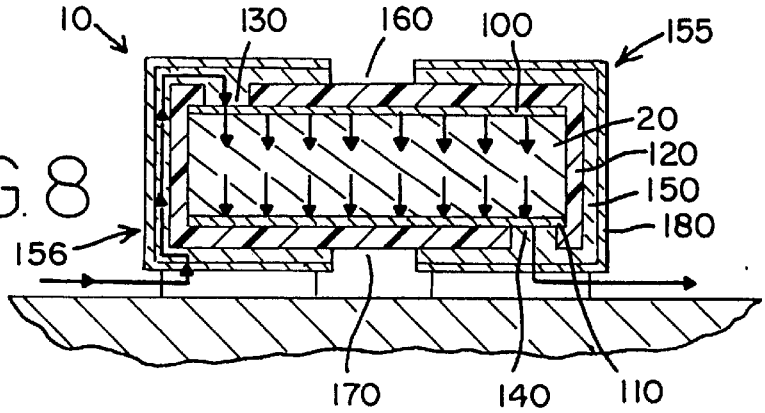
FIG. 8 is a cross-sectional view of a preferred embodiment of the device in FIG. 1 soldered to a PC board.

With reference to FIG. 8, the arrows indicate the flow of current through the device. The end terminations allow current to flow from a conductive terminal of a PC board, around the outer edge of the device (via the first end termination), to the first electrode at the first contact point. The current then flows through the PTC element to the second electrode. Current exits the device through the contact point of the second end termination and continues to flow through the remainder of the circuit.

Figure 9:
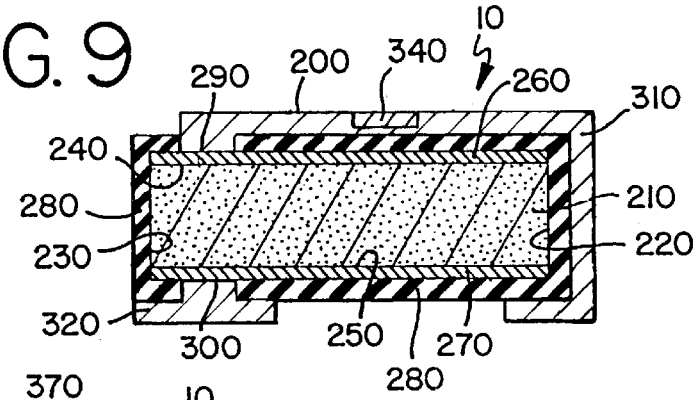
FIG. 9 is a cross-sectional view of an electrical device according to one embodiment of the present invention wherein a fusible element is electrically connected in series with a PTC element.
Figure 10:
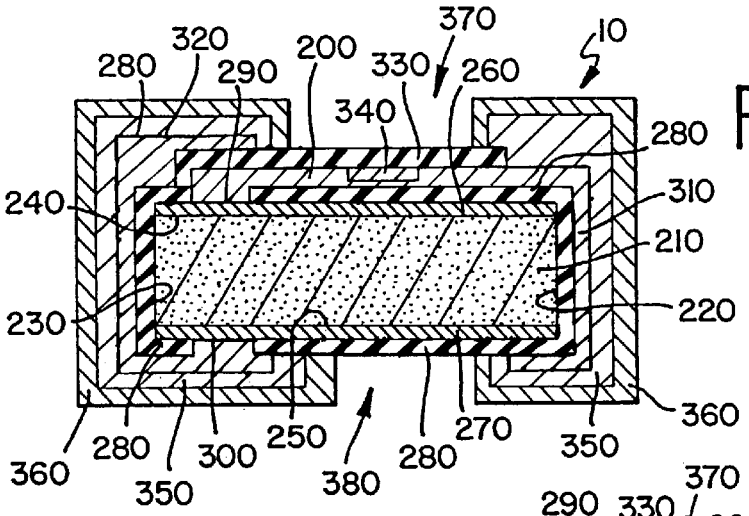
FIG. 10 is a cross-sectional view of an electrical device according to another embodiment of the present invention wherein a fusible element is electrically connected in series with a PTC element.

Referring now to the embodiments illustrated in FIGS. 9–10, there is shown a circuit protection device 10 having a fusible element 200 electrically connected in series with a PTC element 210. Similar to the embodiments described above, the PTC element 210 has first and second sidewalls 220,230 connected to top and bottom surfaces 240,250. First and second electrodes 260,270 are in electrical contact with the PTC element 210.

An insulating layer 280 is deposited on the first and second electrodes 260,270 and wraps around the sidewalls 220,230 of the PTC element 210. Portions of the insulating layer 280 are removed to form first and second contact points 290,300.

A first conductive layer 310 is deposited on the insulating layer 280 and is in electrical contact with the first electrode 260. A second conductive layer 320 is also deposited on the insulating layer 280 and is in electrical contact with the second electrode 280. Preferably, the first conductive layer 310 is in direct physical contact with the first electrode 260 at the first contact point 290 and the second conductive layer 320 is in direct physical contact with the second electrode 270 at the second contact point 300. In order to make electrical contact from the same side of the device 10, the first conductive layer 310 wraps around the first sidewall 220 of the PTC element 210.

As shown in FIG. 9, the second conductive layer 320 may be adjacent the bottom surface 250 of the PTC element only. Alternatively, as shown in FIG. 10, the second conductive layer 320 may wrap around the second sidewall 230 of the PTC element 210. In either embodiment, the insulating layer 280 is interposed between the PTC element 210 and both conductive layers 310,320 except for the electrical connections made at first and second contact points 290,300.

In contrast to the embodiments illustrated in FIGS. 9 and 10, the insulating layer 280 is not required to wrap completely around the first and second sidewalls 220,230 of the PTC element 210. For example, with reference to FIG. 11, the insulating layer 280 only wraps around a portion of the sidewalls 220,230. Portions of the first and second electrodes 260,270 adjacent to the sidewalls 220,230 and extending the length of the sidewalls 220,230 are removed to form insulation channels 325. The insulation channels 325 are filled by the insulating layer 280 to prevent short circuits from occurring between the conductive layers 310,320 and the electrodes 260,270. In essence, the PTC element 210 is "framed" at each corner by the insulating layer 280.

In another embodiment (not shown), the insulating layer 280 does not wrap around and extend down the sidewalls 220,230. In this embodiment, however, it is preferred to include the insulation channels 325 to prevent short circuits as discussed above.

Figure 11:
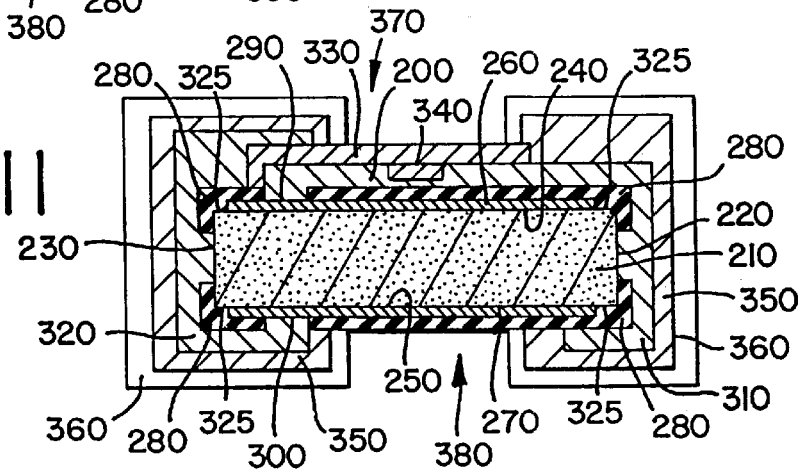
FIG. 11 is a cross-sectional view of an electrical device according to yet another embodiment of the present invention wherein a fusible element is electrically connected in series with a PTC element.

In the embodiments illustrated in FIG. 11 and wherein the insulating layer 280 does not wrap around and extend down the sidewalls 220,230, the first and second conductive layers 310,320 wrap around and are in direct contact with at least a portion of the sidewalls 220,230 of the PTC element 210.

Figure 12:
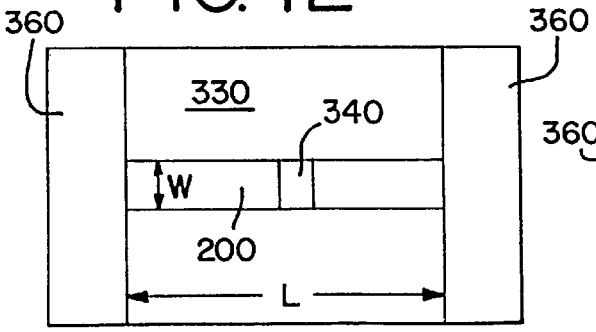
FIGS. 12–13 are top plan views of electrical devices according to the present invention with fusible elements of varying configurations.
Figure 13:
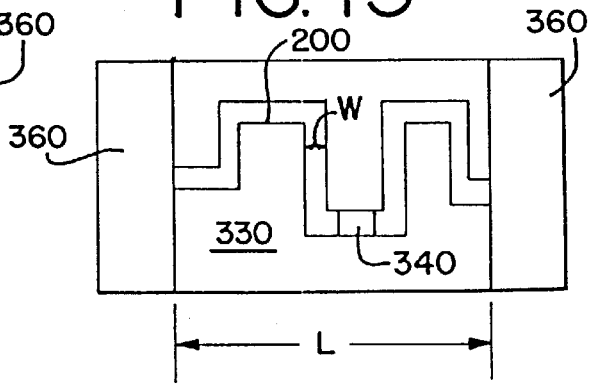

Referring now to FIGS. 9–11, a portion of the first conductive layer 310 adjacent a central portion of the PTC element 210 (i.e., between first and second sidewalls 220, 230) forms a fusible element 200 such that the PTC element 210 and the fusible element 200 are electrically connected in series. The fusible element 200 may take numerous shapes and sizes according to the desired electrical rating of the device 10. For example, the fusible element 200 illustrated in FIG. 13 has a comb-like or serpentine configuration which can be varied to accommodate different ratings. Generally, however, the fusible element 200 will take a configuration similar to the narrow longitudinal strip illustrated in FIG. 12, with a width, W, between about 0.0001–0.1 inch and a length, L, between about 0.005–0.150 inch.

The fusible element 200 is comprised of a conductive material having an electrical resistivity less than the electrical resistivity of the PTC element 210. Generally the conductive material will be a metal or metal alloy (e.g., nickel, copper, silver, tin, gold and alloys thereof). In a preferred embodiment, the fusible element 200 comprises copper and includes a diffusion bar 340. The diffusion bar 340 is composed of a quantity of tin (or alloy thereof) deposited on the fusible element 200 and acts to lower the melting point of the copper in contact with the tin (or alloy thereof). Thus, the blowing temperature of the fusible element 200 is reduced. The blowing temperature of the fusible element 200 can be controlled by varying the amount of tin (or alloy thereof) deposited on the copper. Additionally, by reducing the blowing temperature of the fusible element 200 a lower melting point material may be used to form the insulating layer 280 (the layer upon which the first conductive layer 310 and fusible element 200 are deposited). The diffusion bar 340 also increases the overall melting energy, $I^2t$, of the device 10.

With reference to FIGS. 10 and 11, a second insulating layer 330 is deposited on and covers the fusible element 200 and the diffusion bar 340. Preferably, the second insulating layer 330 is composed of a transparent material. Colored, clear materials may also be used for insulating layer 330. Color coding may be accomplished through the use of a colored insulating layer 330. In other words, different colors of dielectric material can correspond to different amperages, providing the user with a ready means of determining the amperage of any given device. The transparency of the insulating layer 330 permits the user to visually inspect the fusible element 200 prior to installation, and during use, of the electrical device.

The second insulating layer 330 cooperates with the first insulating layer 280 to isolate the first conductive layer 310 from the second conductive layer 320 and decrease the likelihood of a short circuit occurring between the layers 310,320.

As previously mentioned, first and second conductive layers 310,320 preferably comprise copper. With reference to FIGS. 10 and 11 a third conductive layer 350, preferably comprising nickel, is deposited on the first and second 310,320 conductive layers. A fourth conductive layer 360, preferably solder, tin or a mixture of tin and lead, is deposited on the third conductive layer 350 to promote solderability to additional components (e.g., a printed circuit board).

The nickel layer acts as a barrier layer between the copper and solder layers. Without the nickel layer, the copper layer would diffuse into the solder layer or visa-versa forming an intermetallic region. The intermetallic region could alter the physical and electrical characteristics of the device.

The third and fourth conductive layers 350,360 are interrupted by electrically non-conductive gaps 370,380. The gaps 370,380 prevent current from flowing circularly around the PTC element 210 rather than flowing through the PTC element 210 and the fusible element 200.

It should be understood that the first and second contact points 290,300 may be formed at any point along the first and second electrodes 260,270. For example, as illustrated in FIGS. 9–11, the contact points 290,300 may be formed closer to either the first or second sidewall 220,230 of the PTC element 210 than to the other sidewall of the PTC element 210. Alternatively, as illustrated in FIGS. 6–8, the first contact point 290 may be formed closer to the first sidewall 220 than the second sidewall 230, while the second contact point 300 is formed closer to the second sidewall 230 than the first sidewall 220.

As discussed above, the insulating layers 280,330 may be comprised of any electrically non-conducting material; however, in a preferred embodiment the insulating layers are formed from a material consisting of photo resist, dielectric, ceramic, epoxy and solder mask. The first and second conductive layers 310,320 may be formed from a metal selected from the group consisting of nickel, copper, silver, tin, zinc, gold and alloys thereof. As previously mentioned, copper is especially preferred.

The PTC element 210 is comprised of a crystalline polymer having a conductive filler dispersed therein. The preferred compositions discussed above with respect to resistive element 20 (referenced in FIGS. 2–3 and 6–8) are also the preferred compositions for the PTC element 210 (referenced in FIGS. 9–11).

The electrical devices illustrated in FIGS. 9–13 can be manufactured according to the processing steps discussed above for the devices illustrated in FIGS. 1–8. For example, the device illustrated in FIG. 11 can be manufactured by starting with the terminated laminar sheet illustrated in FIG. 4A. The insulation channels 325 are formed by etching away portions of the electrodes 260,270. The insulating layer 280 is applied to the first and second electrodes 260,270, filling the insulation channels 325. The first and second contact points 290,300 are created according to the previously discussed masking and photolithographic processes. The first conductive layer 310 is disposed on the insulating layer 280 making electrical contact with the first contact point 290. Portions of the first conductive layer 310 are etched away to form fusible element 200. The diffusion bar 340 is applied to the fusible element 200 by any conventional deposition process.

At this point, second insulating layer 330 is deposited on the first conductive layer 310, covering the fusible element 200 and the diffusion bar 340. The second conductive layer 320 is then disposed on the insulating layers 280,330 making electrical contact with the second electrode 270 at the second contact point 300. A portion of the second conductive layer 320 is etched away, leaving behind a portion which wraps around the second sidewall of the PTC element 210. A portion of the second insulating layer 330 is then removed, exposing a portion of the first conductive layer 310 that wraps around the first sidewall of the PTC element 210.

The strips are completely coated with third and fourth conductive layers 350,360. Portions of the third and fourth conductive layers 350,360 are then etched away to form electrically non-conductive gaps 370,380. As a result, first and second end terminations are created. In the final step, the strips are divided at each break point into a plurality of electrical devices. The electrical devices have an electrical resistance at approximately 25° C. of less than 1 ohm, preferably less than 0.5 ohm and especially less than 0.1 ohm.

What is claimed is:

1. An electrical device comprising:

a conductive polymer PTC element having first, second, third and fourth sidewalls connected to first and second surfaces;

a first electrode disposed on the first surface of the PTC element and a second electrode disposed on the second surface of the PTC element;

an insulating layer disposed on the first and second electrodes;

a first electrical contact point on the first electrode and a second electrical contact point on the second electrode, the first and second electrical contact points extending from the third sidewall to the fourth sidewall of the PTC element along the first and second electrodes, respectively;

a first conductive layer disposed on the insulating layer defining a first end termination;

a second conducive layer disposed on the insulating layer and contacting the second electrode along the second contact point;

the first end termination wrapping around the first sidewall of the PTC element and being electrically connected to the first electrode along the first contact point; and a fusible element disposed on the insulating layer connecting the first end termination to the first contact point, the fusible element being electrically connected in series with the PTC element.

2. The electrical device of claim 1, wherein the insulating layer covers the electrodes except at the first and second contact points.

3. The electrical device of claim 1, wherein the insulating layer is interposed between the first sidewall of the PTC element and the first end termination.

4. The electrical device of claim 1, wherein the second conductive layer defines a second end termination, the second end termination wrapping around the second sidewall of the PTC element.

5. The electrical device of claim 1, wherein a protective layer covers the fusible element.

6. The electrical device of claim 1, wherein a portion of the first conductive layer forms each of the fusible element and the fist end termination.

7. The electrical device of claim 1, wherein the first and second electrodes include insulation channels adjacent the first and second sidewalls of the PTC element, respectively, the insulating layer being disposed in the insulation channels.

8. The electrical device of claim 1 further comprising a third conductive layer disposed on the first and second conductive layers.

9. The electrical device of claim 8 further comprising a fourth conductive layer disposed on the third conductive layer.

10. The electrical device of claim 1, wherein the first contact point is on the first electrode closer to either the first or second sidewall of the PTC element and the second contact point is on the second electrode closer to the other of either the first or second sidewall of the PTC element.

11. The electrical device of claim 1, wherein the PTC element is composed of a crystalline polymer having conductive particles dispersed therein and an electrical resistivity at 25° C. of less than 2 ohm cm.

12. The electrical device of claim 1, wherein the first contact point is closer to the first sidewall of the PTC element than to the second sidewall of the PTC element and the second contact point is closer to the second sidewall of the PTC element than to the first sidewall of the PTC element.

13. The electrical device of claim 1, wherein the insulating layer is formed from a material selected from the group of photo resist, dielectric, ceramic, epoxy and solder mask.

14. The electrical device of claim 1, wherein the first and second conductive layers comprise a metal selected from the group consisting of nickel, copper, silver, tin, zinc, gold and alloys thereof.

15. The electrical device of claim 8, wherein the third conductive layer comprises a metal selected from the group of nickel, copper, silver, tin, zinc, gold and alloys thereof.

16. The electrical device of claim 1, wherein the first and second conductive layers comprise copper.

17. The electrical device of claim 8, wherein the third conductive layer comprises nickel.

18. The electrical device of claim 9, wherein the fourth conductive layer comprises solder.

19. The electrical device of claim 1, wherein the fusible element has a width, W, between 0.0001–0.1 inch and a length, L, between 0.005–0.150 inch.

20. A surface mountable electrical device comprising:

a laminar PTC element comprised of a polymer component having a conductive filler dispersed therein, the PTC element having first, second, third and fourth sidewalls connected to first and second surfaces;

a first electrode disposed on the first surface of the PTC element and a second electrode disposed on the second space of the PTC element;

an insulating layer disposed on the first and second electrodes;

a first electrical contact point on the first electrode and a second electrical contact point on the second electrode, the first and second electrical contact points extending from the third sidewall to the four sidewall of the PTC element along the first and second electrodes, respectively;

a first conductive layer disposed on the insulating layer defining a first end termination, the first end termination electrically connected to the first electrode along the first contact point and wrapping around the first sidewall of the PTC element;

a second conductive layer disposed on the insulating layer defining a second end termination, the second end termination electrically connected to the second electrode along the second contact point and wrapping around the second sidewall of the PTC element;

a fusible element disposed on the insulating layer connecting the first end termination to the first contact point, and electrically connected in series with the PTC element; and a third conductive layer disposed on the first and second end terminations.

21. The electrical device of claim 20, wherein the insulating layer covers the first and second electrodes except at the first and second contact points.

22. The electrical device of claim 20, wherein the fusible element includes a diffusion bar.

23. The electrical device of claim 22, wherein the diffusion bar is formed from a conductive material other than the material forming the first conductive layer.

24. The electrical device of claim 22, wherein the diffusion bar comprises tin or an alloy thereof.

25. The electrical device of claim 20, wherein the PTC element and the fusible element each have an electrical resistivity, the resistivity of the PTC element being greater than the resistivity of the fusible element.

26. The electrical device of claim 20, wherein the fusible element is serpentine shaped.

27. The electrical device of claim 20, further comprising a protective layer covering the fusible element.

28. The electrical device of claim 27, wherein the protective layer is composed of a transparent material.

29. The electrical device of claim 20, wherein the first and second conductive layers comprise a metal selected from the group of nickel, copper, silver, tin, zinc, gold and alloys thereof.

30. The electrical device of claim 22, further comprising a fourth conductive layer disposed on the third conductive layer.

31. The electrical device of claim 20, wherein the first and second conductive layers comprise copper, the third conductive layer comprises nickel and the fourth conductive layer comprises a mixture of tin and lead.

32. The electrical device of claim 20, wherein the device has a resistance at 25° C. of less than 1 ohm.

33. The electrical device of claim 20, wherein the device has a resistance at 25° C. of less than 0.5 ohm.

34. A surface mountable electrical device comprising: a laminar PTC element comprised of a polymer component having a conductive filler dispersed therein, the PTC element having an electrical resistivity at approximately 25° C. of less than 2 ohm cm;

the PTC element having first, second, third and fourth sidewalls connected to first and second surfaces;

a first electrode disposed on the first surface of the PTC element and a second electrode disposed on the second surface of the PTC element;

an insulating layer disposed on the first and second electrodes;

a first contact point on the first electrode extending from the third sidewall to the fourth sidewall of the PTC element and a second contact point on the second electrode extending from the third sidewall to the fourth sidewall of the PTC element;

first conductive layer disposed on the insulating layer defining first end termination, the first end termination wrapping around the first sidewall of the PTC element and making electrical contact with the first electrode along the first contact point;

a second conductive layer disposed on the insulating layer defining a second end termination, the second end termination wrapping around the second sidewall of the PTC element and making electrical contact with the second electrode along the second contact point;

a fusible element disposed on the insulation layer connecting the first end termination to the first contact point, the fusible element electrically connected in series with the PTC element;

a third conductive layer formed on the first and second end terminations; and a protective layer covering the fusible element and electrically separating the first conductive layer from the second conductive layer.

* * * * *

UNITED STATES PATENT AND TRADEMARK OFFICE

CERTIFICATE OF CORRECTION

PATENT NO. : 5,907,272
DATED : May 25, 1999
INVENTOR(S) : Katherine M. McGuire

It is certified that error appears in the above-identified patent and that said Letters Patent is hereby corrected as shown below:

| Column | Line | |
|---|---|---|
| 13 | 9 | change "fist" to **"first"** |
| 13 | 62 | replace "... space..." with **"surface"** |
| 14 | 45 | dependent claim **30** should depend from claim 20 <u>not</u> claim 22 |
| 14 | 48 | dependent claim **31** should depend from claim 30 <u>not</u> claim 20 |
| 15 | 6 | insert "**<u>a</u>**" before "first conductive layer" |

Signed and Sealed this

Twenty-third Day of May, 2000

*Attest:*

Q. TODD DICKINSON

*Attesting Officer*

*Director of Patents and Trademarks*